US010550841B2

(12) United States Patent
Kasahara et al.

(10) Patent No.: US 10,550,841 B2
(45) Date of Patent: Feb. 4, 2020

(54) OILLESS COMPRESSOR

(71) Applicant: Hitachi Industrial Equipment Systems Co., Ltd., Chiyoda-ku, Tokyo (JP)

(72) Inventors: Masayuki Kasahara, Tokyo (JP); Hideharu Tanaka, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 219 days.

(21) Appl. No.: 15/553,202

(22) PCT Filed: Feb. 12, 2016

(86) PCT No.: PCT/JP2016/054047
§ 371 (c)(1),
(2) Date: Aug. 24, 2017

(87) PCT Pub. No.: WO2016/136482
PCT Pub. Date: Sep. 1, 2016

(65) Prior Publication Data

US 2018/0238329 A1 Aug. 23, 2018

(30) Foreign Application Priority Data

Feb. 25, 2015 (JP) ..... 2015-034693

(51) Int. Cl.
*F03C 2/00* (2006.01)
*F03C 4/00* (2006.01)
(Continued)

(52) U.S. Cl.
CPC ..... *F04C 18/16* (2013.01); *F04C 29/04* (2013.01); *F04C 29/005* (2013.01);
(Continued)

(58) Field of Classification Search
CPC ..... F04C 18/16; F04C 29/005; F04C 29/025; F04C 29/04; F04C 2210/206;
(Continued)

(56) References Cited

U.S. PATENT DOCUMENTS 4,693,736 A 9/1987 Klusmier
5,263,832 A 11/1993 Yamaguchi
(Continued)

FOREIGN PATENT DOCUMENTS

CN 102983679 A 3/2013
DE 197 45 616 A1 4/1999
(Continued)

OTHER PUBLICATIONS

Chinese-language Office Action issued in counterpart Chinese Application No. 201680012028.4 dated Jun. 27, 2018 with English translation (12 pages).
(Continued)

*Primary Examiner* — Theresa Trieu
(74) *Attorney, Agent, or Firm* — Crowell & Moring LLP

(57) ABSTRACT

Size reduction of a compressor and cooling of an electric motor are effectively achieved. An oilless compressor, having: a compressor main body that has a rotor for compressing air, a rotor shaft for supporting the rotor, and a bearing for rotatably supporting the rotor shaft; an electric motor for producing drive force for driving the compressor main body; at least one gear for transmitting drive force to the rotor shaft; a lubricating oil pipe for conveying lubricating oil to the bearing and/or the gear; and an oil pump for pressure-feeding the lubricating oil; wherein the electric motor has, in the external peripheral direction of an armature, a cooling jacket for channeling the lubricating oil to an internal flow
(Continued)

channel to cool the armature of the electric motor, and the lubricating oil circulates through the cooling jacket and the lubricating oil pipe.

14 Claims, 6 Drawing Sheets

(51) Int. Cl.

| | |
|---|---|
| ***F04C 15/00*** | (2006.01) |
| ***F04C 2/00*** | (2006.01) |
| ***F04C 18/16*** | (2006.01) |
| ***F04C 29/04*** | (2006.01) |
| *F04C 29/02* | (2006.01) |
| *F04C 29/00* | (2006.01) |

(52) U.S. Cl.
CPC .... *F04C 29/025* (2013.01); *F04C 2210/1005* (2013.01); *F04C 2210/206* (2013.01); *F04C 2240/30* (2013.01); *F04C 2240/40* (2013.01); *F04C 2240/806* (2013.01); *F04C 2270/24* (2013.01)

(58) Field of Classification Search
CPC ..... F04C 2210/1005; F04C 2240/30; F04C 2240/40; F04C 2240/806; F04C 2270/24
USPC ..... 418/94, 98–101, 102, 201.1
See application file for complete search history.

(56) References Cited

U.S. PATENT DOCUMENTS 5,846,062 A * 12/1998 Yanagisawa ..... F04C 18/00 417/410.4
6,133,659 A * 10/2000 Rao ..... B60K 6/105 310/89
6,287,088 B1 9/2001 Nishimura et al.
6,315,535 B1 * 11/2001 Hoshi ..... F04C 18/16 418/201.1
6,544,020 B1 4/2003 Bahnen et al.
7,232,295 B2 * 6/2007 Kriehn ..... F04C 18/16 418/201.1
7,413,419 B2 * 8/2008 De Smedt ..... F04C 18/00 417/410.4

FOREIGN PATENT DOCUMENTS

| | | | |
|---|---|---|---|
| EP | 0 574 104 | A1 | 12/1993 |
| JP | 8-284863 | A | 10/1996 |
| JP | 2007-113588 | A | 5/2007 |
| JP | 2009-174491 | A | 8/2009 |

OTHER PUBLICATIONS

Japanese-language Office Action issued in counterpart Japanese Application No. 2017-502059 dated Jun. 29, 2018 with unverified English translation (seven pages).
Extended European Search Report issued in counterpart European Application No. 16755229.8 dated Sep. 14, 2018 (eight pages).
International Search Report (PCT/ISA/210) issued in PCT Application No. PCT/JP2016/054047 dated May 24, 2016 with English translation (three pages).
Japanese-language Written Opinion (PCT/ISA/237) issued in PCT Application No. PCT/JP2016/054047 dated May 24, 2016 (four pages).

* cited by examiner

OILLESS COMPRESSOR

TECHNICAL FIELD

The present invention pertains to an oilless compressor, and relates to an oilless compressor including a lubricating oil system that performs lubricating a machine element in the compressor, cooling a power source for driving the machine element, and so on.

BACKGROUND ART

As an air compressor, which is one of typical types of compressors, there are some types, such as an oil-feed type which is configured to inject oil into a compression operation chamber, an oilless type which does not inject oil. Furthermore, the oilless type air compressors also have some types such as a water-injection type and a dry type one; the water-injection type injects water, and the dry type does not. Hereinafter, an oilless type air compressor, including a water-injection type and a dry type one, may be referred to as an oilless compressor.

Although an oilless compressor does not feed oil into a compression operation chamber, it is generally necessary to feed with oil for lubrication into some parts located outside of the compression operation chamber, i.e., a bearing, a drive gear for transmitting power from a power source such as an electric motor, and a timing gear used in, for example, a screw compressor having two or more rotors. Furthermore, in a dry type oilless compressor, a compressor body has a high temperature because of adiabatic compression; therefore, for example, in order to suppress thermal deformation of a housing of the compressor body, there are some dry type oilless compressors that are provided with a cooling jacket around a compression chamber, thus cooling the compression chamber with liquid such as water, coolant, oil or so.

Patent Literature 1 discloses an example of the structure of a lubricating oil system of an oilless compressor. The oilless compressor disclosed in Patent Literature 1 is a screw compressor having female and male rotors, and it is structured to use a gear casing (at the lower part thereof) as an oil sump; the gear casing houses a gear connecting a male rotor shaft, which is a driven shaft, and a drive shaft that drives the male rotor shaft.

The gear casing has a function of accumulating the amount of oil necessary for circulation, and, in addition, is provided with an atmospheric communicating tube for letting the internal pressure escape, thus dropping the pressure toward about the same as the atmospheric pressure when it has become excessively high within the casing. Furthermore, as a structure for communication between the air part in the gear casing and the air part in an ending cover of the compressor, it is structured to equalize the internal pressure between the ending cover and the gear casing.

The screw compressor disclosed in Patent Literature 1 is structured to use the gear casing as an oil sump, thereby making it possible to accumulate the amount of oil needed to be fed to a compressor body, and also to maintain the internal pressure of the gear casing at about the same as the atmospheric pressure, so that the drainage of oil from the compressor body can be performed smoothly, and the circulation and feeding of lubricating oil to machine elements such as bearings and timing gears of the compressor body can be performed properly.

CITATION LIST

Patent Literature

PATENT LITERATURE 1: JP H8-284863 A

SUMMARY OF INVENTION

Technical Problem

Here, with respect to cooling of a drive source for driving a compressor body, for example, electric motors may be used as a drive source; most of them are an air-cooled type. An air-cooled electric motor may be inferior in cooling capacity as compared with a liquid-cooled electric motor. To compensate for this, if a big radiating fin is provided on the outer circumference of a housing of a compressor, or if the size or rotation speed of a cooling fan for generating cooling air is increased, which makes the size of the compressor or the energy consumption increased.

On the other hand, a liquid-cooled electric motor is superior in cooling performance; however, a dedicated refrigerant for a compressor and a path for the refrigerant are provided in general, which causes the increasing size or the complicated configuration of the compressor. In particular, given that room for an oil sump is secured in a gear casing, the size of the compressor is increased further, or the configuration of the compressor is complicated further.

Furthermore, a gear casing is the area where driving force from an electric-motor-side shaft is transmitted to a compressor-side drive shaft, and therefore, the area of the gear casing is preferably as small as possible in consideration of mechanical loss; however, the reduction of this area may be limited due to a constraint to secure room for an oil sump.

There is expected a configuration enabling to efficiently achieve the miniaturization of a compressor and the cooling of an electric motor.

Solution to Problem

To solve the above-described problems, for example, a configuration discussed in claims is applied. Specifically, the configuration is an oilless compressor including: a compressor body having a rotor for compressing air, a rotor shaft for supporting the rotor, and a bearing for rotatably supporting the rotor shaft; an electric motor that generates driving force for driving the compressor body; at least one gear that transmits the driving force to the rotor shaft; a lubricating oil piping that feeds lubricating oil to at least either the bearing or the gear; and an oil pump that pumps the lubricating oil, wherein the electric motor includes a cooling jacket in an outer circumferential direction of an armature of the electric motor, the cooling jacket circulating the lubricating oil into an internal flow path, thereby cooling the armature, and the electric motor circulates the lubricating oil into the cooling jacket and the lubricating oil piping.

Advantageous Effects of Invention

According to the present invention, it is possible to efficiently achieve the miniaturization of a compressor and the improvement in coolability of an electric motor, and also possible to make the securing of assemblability and the aspect of cost more efficient.

DESCRIPTION OF EMBODIMENTS

Embodiments of the present invention are described below with drawings.

Embodiment 1

Figure 1A:
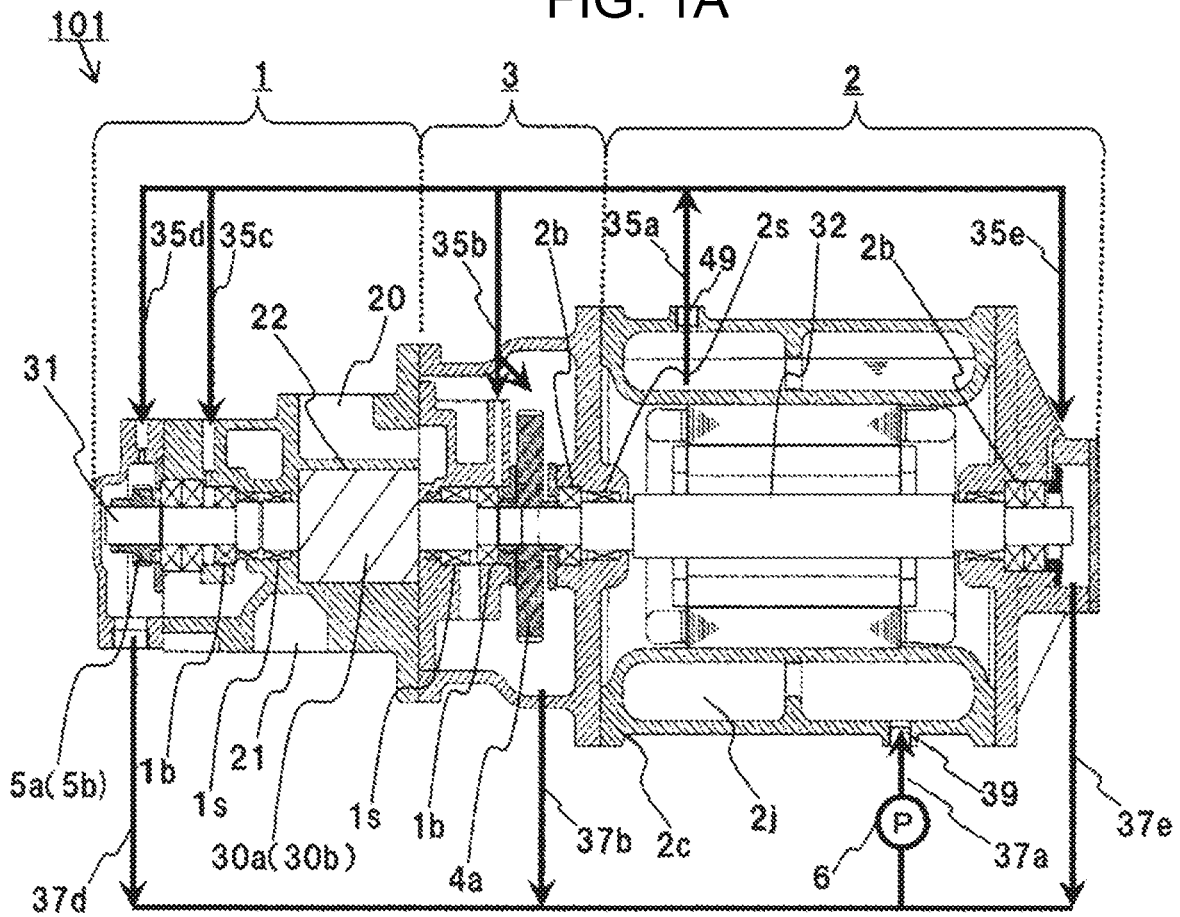
FIGS. 1A and 1B are schematic diagrams showing a longitudinal cross-sectional side view and a horizontal cross-sectional top view of an oilless screw compressor according to Embodiment 1 applied with the present invention.
Figure 1B:
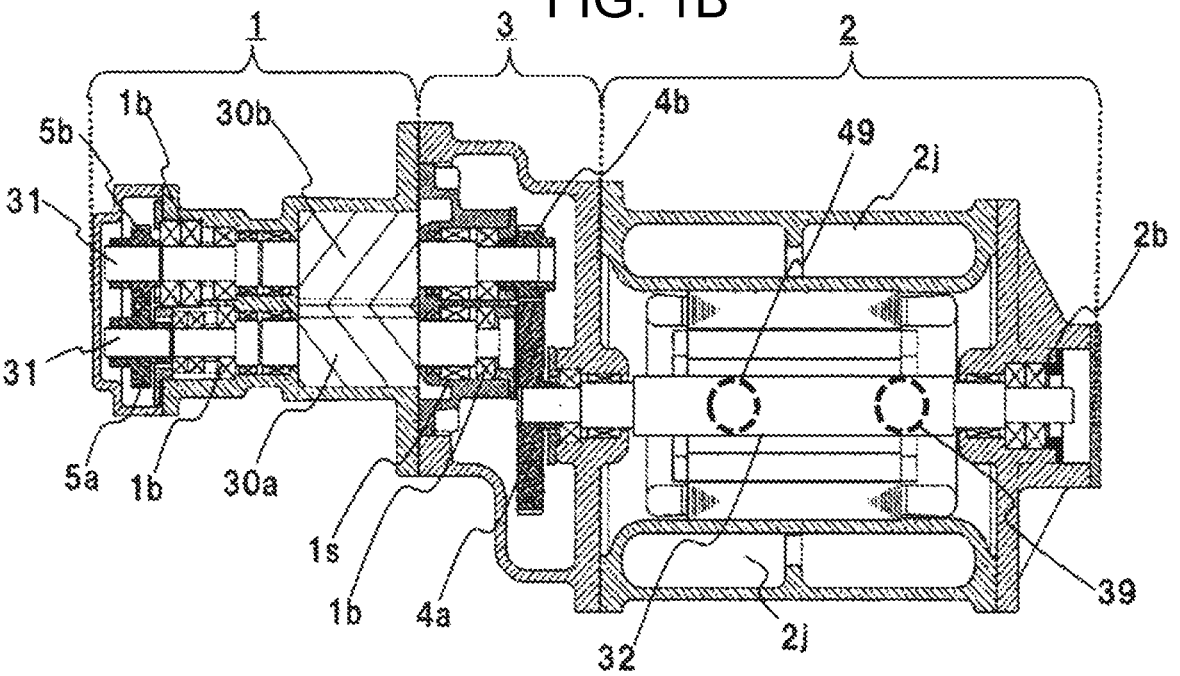

FIG. 1 shows a cross-sectional configuration of an oilless compressor according to Embodiment 1 applied with the present invention (hereinafter, referred to as "compressor 101"). Here, FIG. 1(*a*) is a longitudinal cross-sectional side view, and FIG. 1(*b*) is a horizontal cross-sectional top view. Incidentally, in FIG. 1(*b*), description of some parts of lubricating oil piping system (35*a* to 35*e*, 37*b* to 37*e*) or the like, shown in FIG. 1(*a*) is omitted.

The compressor 101 includes a compressor body 1, an electric motor 2, and a gear casing 3; the compressor body 1 and the electric motor 2 are axially arranged through the gear casing 3. The compressor body 1 includes a pair of male and female screw rotors 30*a* and 30*b*; these screw rotors each rotate in a non-contact state in which there is a predetermined gap between them, thereby compressing air introduced into a compression operation chamber 22 from an air inlet 20 through an air filter (not shown) and ejecting compressed air from an outlet 21. In the present embodiment, the compressor is described as an oilless compressor that does not inject liquid for cooling, lubrication, sealing, etc. into a compression operation chamber; however, it can be a water-feed type compressor. Furthermore, the present embodiment can be applied to even an oil-feed type compressor, for example, if it has separate systems for oil fed into a compression operation chamber and oil for lubricating machine elements such as gears and bearings.

On the ejection side of rotor shafts 31 of each of the male rotor 30*a* and the female rotor 30*b*, a non-contact or a contact compressor body shaft seal is composed of an air sealing, a screw sealing, etc. is installed to prevent the escape of compressed air from the operation chamber 22 to the gear side and, also to prevent the lubricating oil leak from the gear side to the operation chamber 22 side. One or more bearings 1*b* are installed on the further side of the compressor body shaft seal 1*s*, and timing gears 5*a* and 5*b*, which are engaged with the male rotor 30*a* and the female rotor 30*b* respectively, are installed at the distal ends of the rotor shafts 31; the male rotor 30*a* is driven by driving force from the electric motor 2, thereby the male and female rotors rotate in a direction of engaging with each other with a gap between them.

A shaft seal 1*s* composed of a non-contact or a contact air sealing and screw sealing, etc. is installed on the gear casing 3 side of each rotor shaft 31 as well, and beyond the shaft seal 1*s*, one or more bearings 1*b* are installed on the side of the electric motor 2. Then, a driven gear 4*b* is fixed to the gear-casing 3 side end of the rotor shaft 31 of the male rotor 30*a*, and is engaged with a drive gear 4*a* fixed to a motor shaft 32, thereby driving force of the electric motor 2 is transmitted to the male rotor 30*a*.

The gear casing 3 covers the drive gear 4*a*, the driven gear 4*b*, the bearings 1*b* of the compressor body 1, etc. and also has a function as a flange for connecting the compressor body 1 and the electric motor 2. Furthermore, one of the characteristics of the present embodiment is that a space serving as an oil sump is not particularly provided in the lower internal space of the gear casing 3, thereby reducing the size of the gear casing 3.

The electric motor 2 is a radial gap magnet motor having a rotator and a stator. Incidentally, various types of motors, such as an induction motor and an axial gap type one, can be applied. The electric motor 2 includes a substantially cylindrical motor housing 2*c*, one open end thereof in a direction of the rotation axis is formed to have about the same diameter as the outer diameter of the electric-motor-2-side open end of the gear casing 3, and these open ends are connected to each other.

In the motor shaft 32, a shaft seal 2*s* and a bearing 2*b* are installed on the side of the gear casing 3. The shaft seal 2*s* is a non-contact or a contact air sealing and screw sealing, and prevents lubricating oil from leaking from the gear casing 3 side to inside the electric motor 2. Likewise, a bearing 2*b* is installed at the opposite-output-side end of the motor shaft 32 as well.

The motor housing 2*c* is configured to have a double-layered structure almost over the entire circumference of the inner cylinder, and the space formed by such structure is used as a cooling jacket 2*j* for cooling (for example, armatures, such as a stator and a rotator) of the electric motor 2. Specifically, lubricating oil for lubricating various gears installed in the gear casing 3 and on the ejection side of the compressor body 1 is circulated into the cooling jacket 2*j*, and the lubricating oil is also used for cooling of the electric motor 2.

Furthermore, the motor housing 2*c* is provided with an oil inlet 39, which is a return port of lubricating oil circulated back on the bottom thereof, and is also provided with an outlet 49 through which lubricating oil is discharged toward a lubricating oil system on top thereof. By this configuration, the compressor 101 can use the cooling jacket 2*j* as an oil sump without particularly providing an internal space to be used as an oil sump in the gear casing 3.

Incidentally, the cooling jacket 2*j* can be configured to cover only a circumferential direction of the electric motor 2 or also including the bracket side on the opposite output shaft side, or can be configured to be partially installed in the circumferential direction.

Subsequently, the lubricating oil system of the compressor 101 is described.

A piping 35*a* is connected to the outlet 49 of the cooling jacket 2*j*, and the piping 35*a* branches into pipings 35*b*, 35*c*, and 35*d* for feeding lubricating oil to the compressor body 1 side and a piping 35*e* for feeding lubricating oil to the opposite-output-side end of the electric motor 2. The gear casing 3 and a housing of the compressor body 1 are each provided with an oil feed path that runs through from top to inside the apparatus and through which lubricating oil is guided to various gears and bearings; the pipings 35*b*, 35*c*, and 35*d* are connected to the respective oil feed paths. The opposite-output-side bracket of the compressor housing 2 is also provided with a lubrication path through which lubricating oil is guided to the bearing 2*b*, and the piping 35*e* is connected to the path.

Furthermore, on the bottoms of the compressor body 1, the gear casing 3, and the opposite-output-side bracket of the motor housing 2*c*, an outlet of lubricating oil is formed; pipings 37*b*, 37*d*, and 37*e*, which are an outlet piping, are connected to the respective outlets and through which lubricating oil is discharged. The pipings 37*b*, 37*d*, and 37*e* are connected to a piping 37*a* connected to an inlet of an oil pump 6, and lubricating oil is circulated back to the oil inlet 39 of the cooling jacket 2*j* by the oil pump 6.

The oil pump 6 is a pump driven by electricity or mechanical driving force, and can control the amount of lubricating oil to be pumped according to, for example, the number of rotations of the compressor body 1. In the present embodiment, an electromagnetic pump shall be applied; the electromagnetic pump performs variable speed control enabling to appropriately adjust the amount of lubricating oil to be pumped according to a control signal from a control device (not shown) on the basis of the number of rotations of the compressor body 1, the pressure of ejected air, the temperature of lubricating oil, etc.

In this way, according to Embodiment 1, both the lubrication of machine elements such as gears, bearings of the compressor 101 or so and the cooling of the electric motor 2 can be performed with the same lubricating oil. Especially in an oilless screw compressor with rotors having high-speed rotation and high temperature, without causing a complicated configuration and a massive increase in the number of parts, an electric motor can be liquid-cooled with a simple configuration, and it is possible to expect an effect of sufficiently cooling the electric motor 2.

Furthermore, the cooling jacket 2*j* doubles as an oil sump, and therefore, the miniaturization and the simplified configuration of the gear casing 3 can be achieved, and it can be said that this makes the whole volume of the compressor 101 further reduced.

Embodiment 2

An oilless screw compressor according to Embodiment 2 (hereinafter, referred to as "compressor 102") is described. One of the characteristics of the compressor 102 according to the Embodiment 2 is that the compressor 102 further includes a cooling jacket 1*j* in a housing of the compressor body 1, as compared with the compressor 101 in Embodiment 1, and lubricating oil is then circulated into the cooling jacket 1*j* to cool the compressor body 1 as well.

Figure 2A:
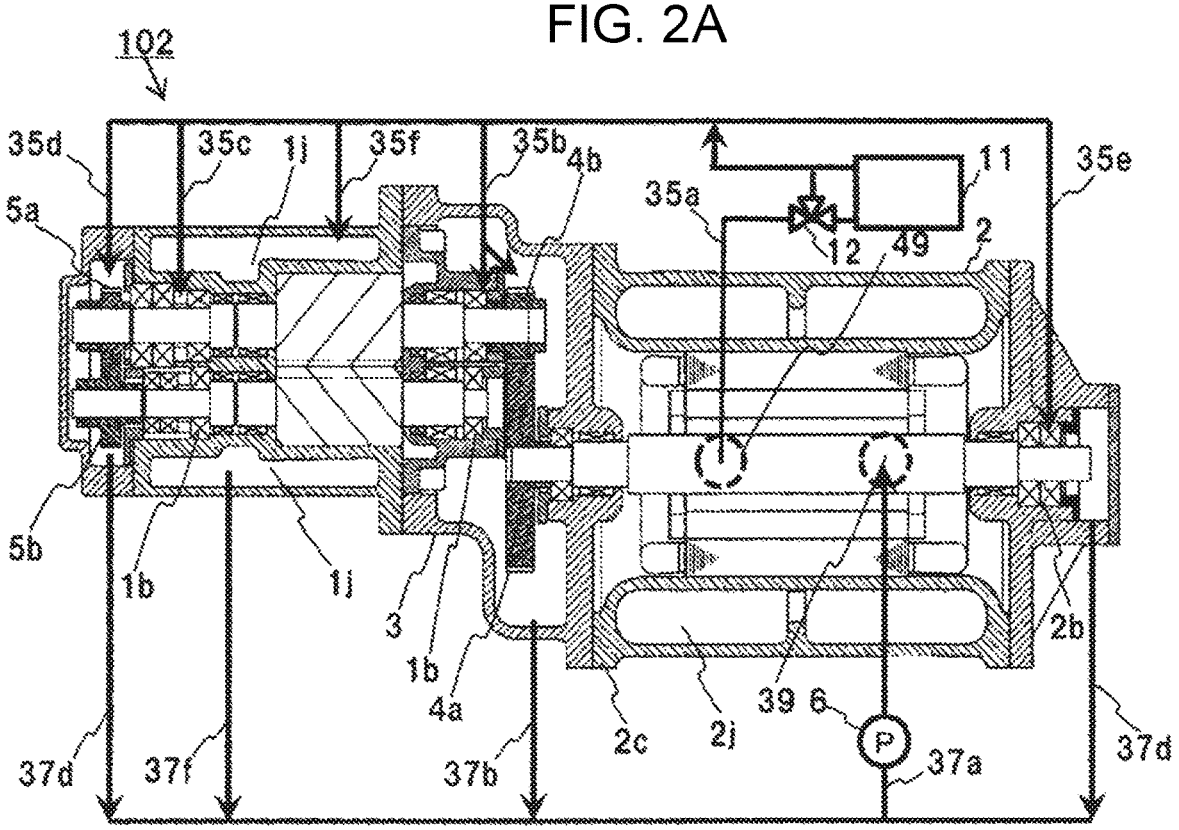
FIGS. 2A and 2B are schematic diagrams showing a horizontal cross-sectional top view of an oilless screw compressor according to Embodiment 2.
Figure 2B:
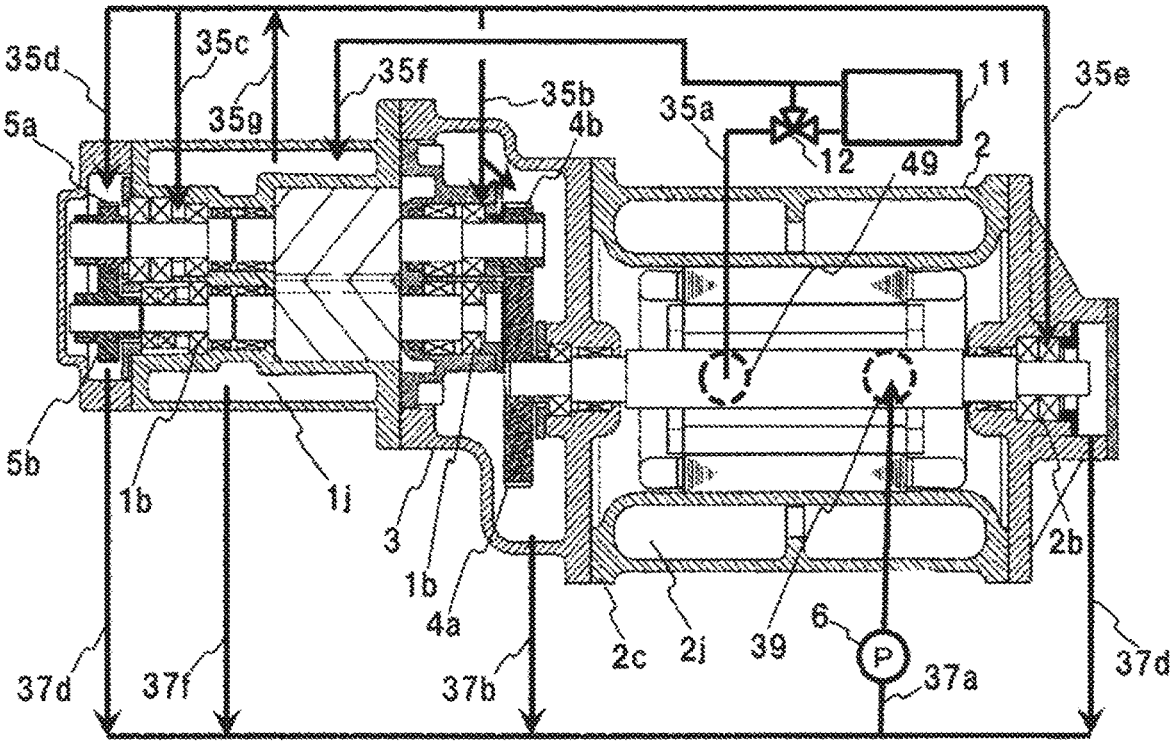

FIG. 2(*a*) shows a horizontal cross-sectional view of the compressor 102. Incidentally, in the following description, the same member as that in Embodiment 1 shall be assigned the same reference numeral, and detailed description of the member is omitted.

The compressor body 1 is configured to have a double-layered structure, just like the motor housing 2*c*, to make the cooling jacket 1*j* on the outer circumference of the body housing lubricating oil fed from the outlet 49 of the cooling jacket 2*j* to the piping 35*a* by driving of the oil pump 6 is fed to the cooling jacket 1*j* through a piping 35*f* branched from the piping 35*a*.

The piping 35*f* is connected to the cooling jacket 1*j* from top of the compressor body 1 or the electric motor 2 (in FIG. 2(*a*), an arrow from the side indicates the installment from the upper side to the lower side), just like the other pipings 35*b*, 35*c*, 35*d*, and 35*e*. Furthermore, a piping 37*f* connected to the piping 37*a* is connected to the lower side of the cooling jacket 1*j*, and lubricating oil is configured to be collected at the oil pump 6.

In the middle of the piping 35*f*, both an air or liquid-cooling oil cooler 11 as lubricating oil cooling way and a temperature control valve 12 for controlling the flow of lubricating oil from the piping 35*f* into the oil cooler 11 are provided. The temperature control valve 12 is configured to open a path to the oil cooler 11 side when the oil temperature has reached a predetermined temperature zone. Incidentally, the path of the temperature control valve 12 can be configured to be switched upon receipt of a signal from a control device (not shown) based on not only the oil temperature but the pressure and temperature of ejected air, the number of rotations of the electric motor, the temperature of inside the electric motor, etc.

In this way, according to Embodiment 2, lubricating oil can be further used as cooling of the compressor body 1. Especially in an oilless screw compressor having high-speed rotation and high temperature, the lubrication of gears and bearings and the cooling of the compressor body 1 and the electric motor 2 can be performed with a simple configuration.

Furthermore, in Embodiment 2, after lubricating oil is cooled by the oil cooler 11, the lubricating oil can be circulated to the compressor body 1 side; therefore, even at the time of high-speed rotation and high temperature, as for the lubrication of gears, etc., the appropriate lubricant viscosity can be ensured, and the coolability of the compressor body 1 can also be ensured.

Incidentally, in the example of FIG. 2, the pipings 35*b*, 35*c*, and 35*d*, which are a gear or a bearing lubrication path, and the piping 35*f*, which is a pipeline to the cooling jacket 1*j*, are parallel paths; however, as shown in FIG. 2(*b*), these can be series paths so that lubricating oil is circulated to the machine element lubrication paths (35*b*, 35*c*, 35*d*) after circulated into the cooling jacket 1*j*.

Embodiment 3

An oilless screw compressor according to Embodiment 3 (hereinafter, referred to as "compressor 103") is described. Embodiment 3 is similar to the compressor 101 in Embodiment 1, and yet differs particularly in that the motor shaft 32 and the rotor shaft 31 of the male rotor 30*a* are configured to be connected directly, and the drive gear 4*a* and the driven gear 4*b* are not provided for driving transmission between these shafts.

Figure 3:
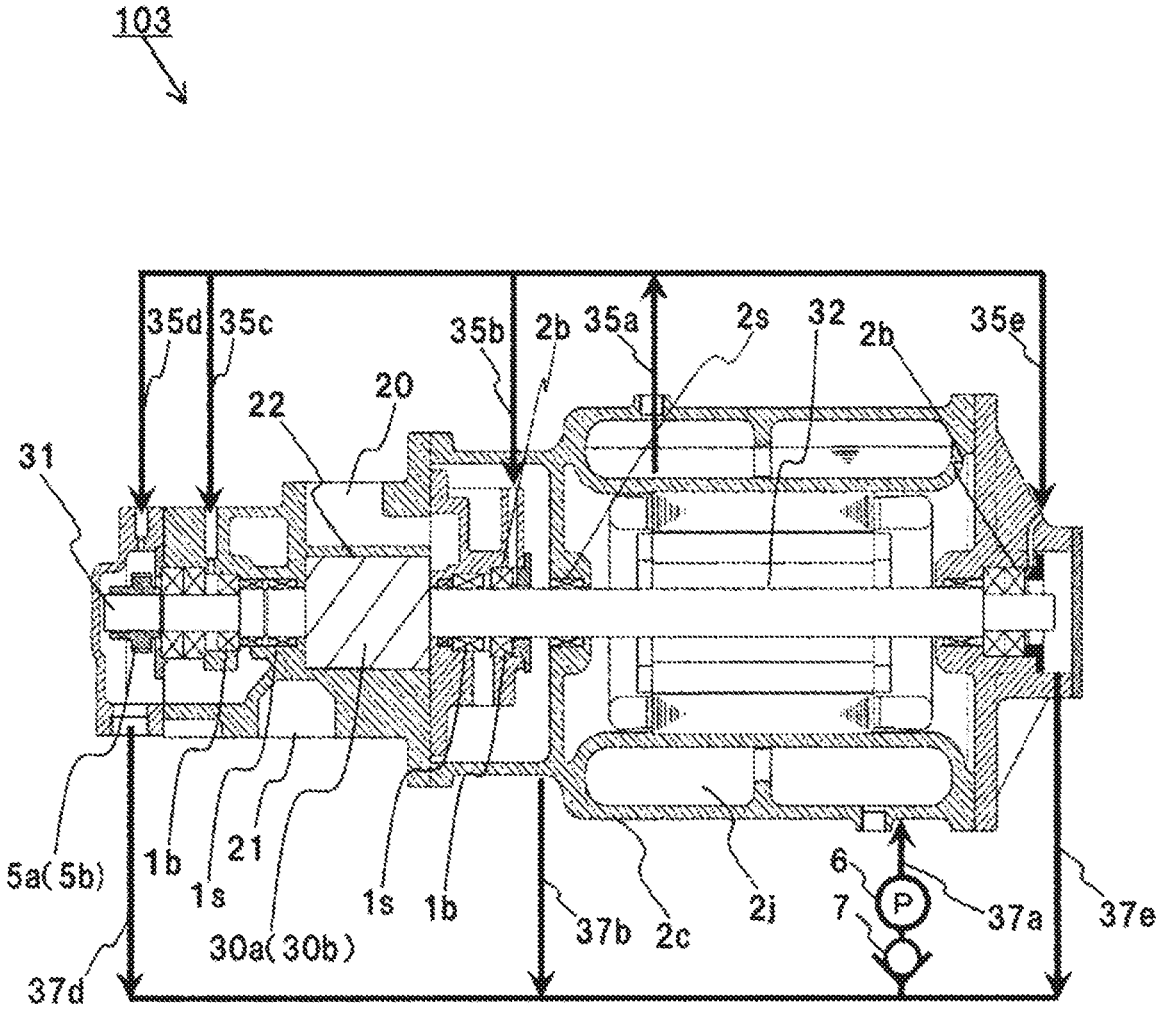
FIG. 3 is a schematic diagram showing a longitudinal cross-sectional side view of an oilless screw compressor according to Embodiment 3.

FIG. 3 shows a longitudinal cross-sectional side view of the compressor 103. In the compressor 103, the motor shaft 32 and the rotor shaft 31 are configured to be connected directly by fitting or shrinkage fitting, or integral molding; therefore, the size of the gear casing 3 can be reduced further. Furthermore, the cooling jacket 2*j* doubles as an oil sump, and therefore, the miniaturization of the gear casing 3 can be promoted further, and it is possible to achieve the miniaturization/compactification of the entire compressor 103.

Here, the outer diameter of the electric motor 2 generally tends to be larger than the outer diameter of the compressor body 1. Specifically, the compressor 103 has the cooling jacket 2*j* in the motor housing 2*c*, thus the outer diameter of the electric motor 2 tends to be further larger. If the compressor 103 is set so that the motor shaft 32 is horizontally installed (transversely placed), the level of lubricating oil in the cooling jacket 2*j* becomes higher than those of parts to be lubricated, such as the bearings 1*b* and 2*b* and the timing gears 5*a* and 5*b*. When no feeding pressure from the oil pump 6 is obtained, such as when the compressor 103 is at a stop, such a level difference from lubricating oil may possibly cause the lubricating oil to flow backward from the oil inlet 39 to a gear chamber or the like of the compressor body 1, etc. through the pipings 37*a*, 37*b*, and 37*d*. Depending on the amount of lubricating oil flowing backward, some or all of the bearings and gears may be temporarily immersed in the lubricating oil, resulting in lubricating oil leak to inside the compression operation chamber 22 or a drag at the time of start up, and it can be said that this becomes a major problem especially for an oilless compressor.

Accordingly, the compressor 103 includes a check valve 7 on the piping 37*a* on the upstream of the oil pump 6. The check valve 7 allows only the flow from the pipings 37*b*, 37*d*, and 37*e* toward the oil pump 6, and prevents the backward flow from the cooling jacket 2*j* to the pipings 37*b*, 37*d*, and 37*e*. Incidentally, the check valve can be an electronically-controlled electromagnetic valve so as to be controlled to be opened/closed at desired timing.

In this way, according to Embodiment 3, the cooling jacket 2*j* serves as an oil sump, which contributes maximally to the advantages of the miniaturization of the gear casing 3 when the motor shaft 32 and the rotor shaft 31 of the male rotor 30*a* are configured to be connected directly.

Furthermore, to cope with an event that the level of lubricating oil in the cooling jacket 2*j* becomes higher than those of parts to be lubricated, the check valve 7 is installed, thereby the backward flow of lubricating oil to the compressor body 1 side can be prevented.

Embodiment 4

Embodiment 4 is described. One of the characteristics of an oilless screw compressor in Embodiment 4 (hereinafter, referred to as "compressor 104") is that an atmosphere communicating part 8 communicated with outside air is provided on top of the cooling jacket 2*j*. Furthermore, the compressor 104 includes an internal piping 9 through which lubricating oil is fed to the bearings 1*b* installed between the male rotor 30*a* and the electric motor 2. Moreover, Embodiment 4 differs from the other embodiments in that the installation positions of the pipings 35*c*, 35*d*, and 35*e* through which lubricating oil is fed from the cooling jacket 2*j* to objects to be lubricated are lower than the level of oil in the cooling jacket 2*j*.

Figure 4A:
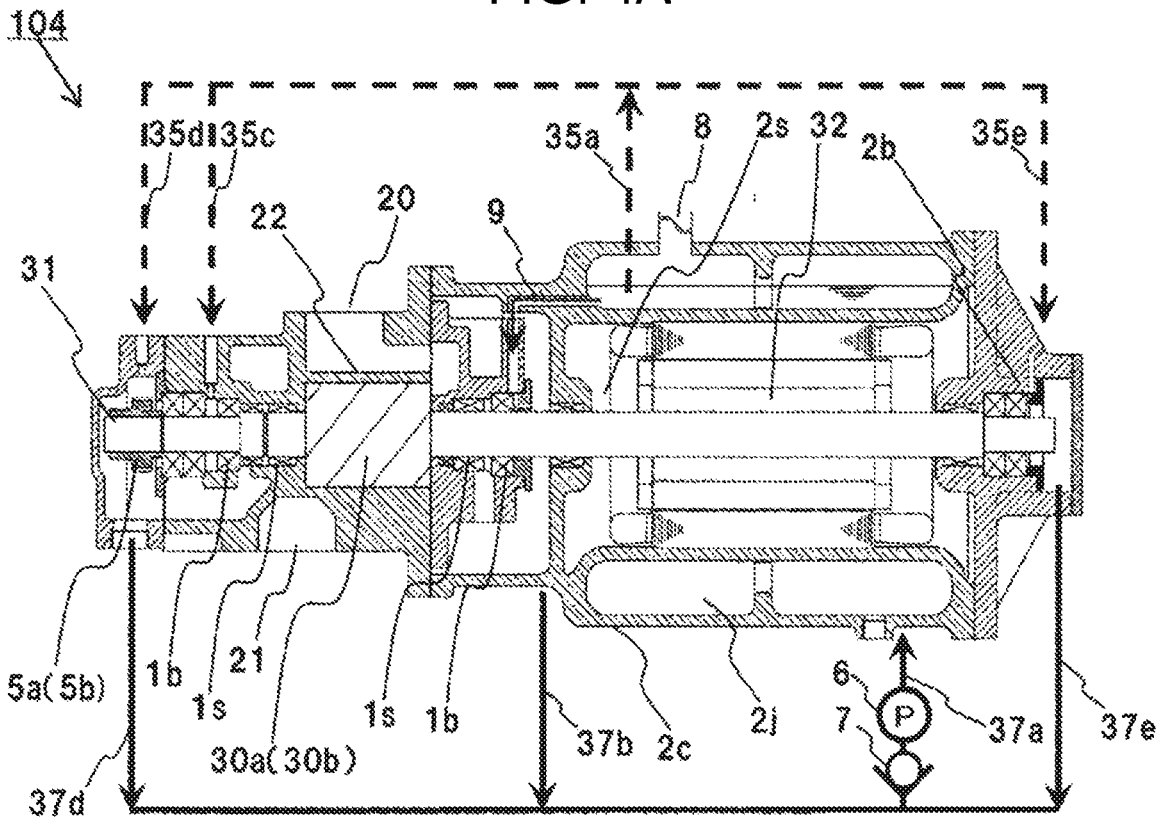
FIGS. 4A and 4B are schematic diagrams showing a longitudinal cross-sectional side view of an oilless screw compressor according to Embodiment 4 and an external configuration of the oilless screw compressor when viewed from the side of a compressor body in a direction of the rotation axis.
Figure 4B:
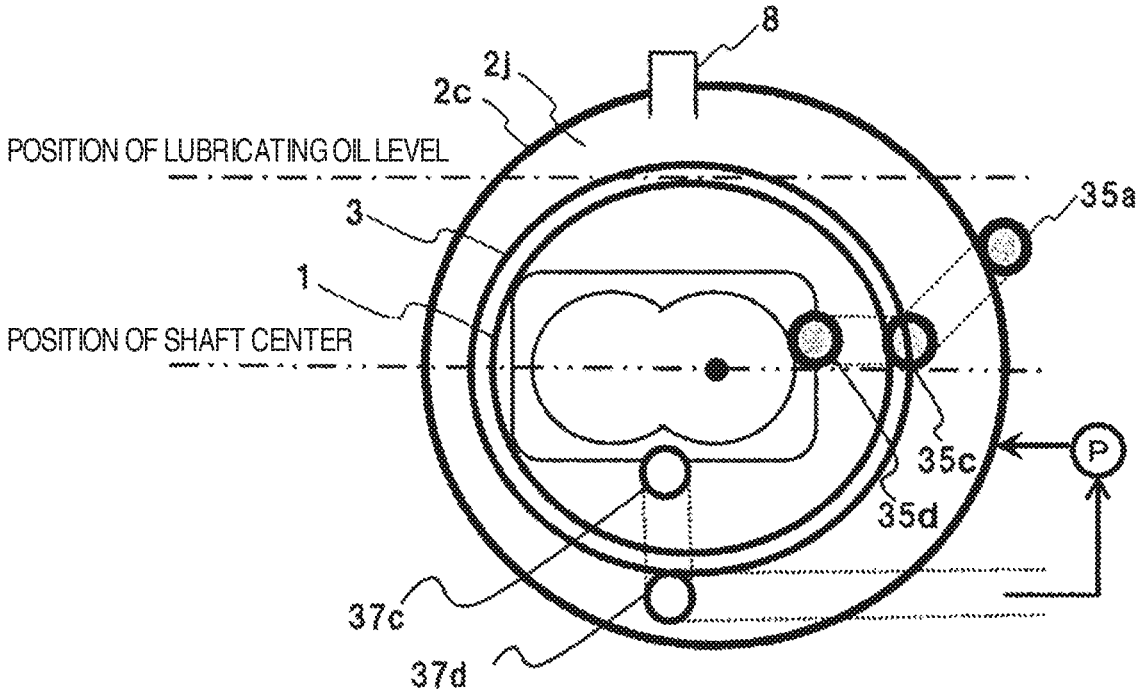

FIG. 4 shows a longitudinal cross-sectional side view of the compressor 104. Incidentally, the compressor 104 is based on the configuration of the compressor 103 in Embodiment 3. The same member as that in Embodiment 3 is assigned the same reference numeral, and detailed description of the member is omitted.

The atmosphere communicating part 8 is composed of a hole or a tube provided on the motor housing 2*c*. The atmosphere communicating part 8 is provided on a portion of the motor housing 2 that is the upper part of the motor housing 2 and is located above the highest level of lubricating oil in the cooling jacket 2*j*. A circulation system of lubricating oil is a substantially enclosed space; therefore, if there is no atmosphere communicating part 8, lubricating oil is circulated depending on the feeding pressure of the oil pump 6. On the other hand, by providing the atmosphere communicating part 8 enabling the introduction of outside air, lubricating oil can have natural circulation (i.e., free fall due to gravity) according to the difference of elevation between systems.

The internal piping 9 is a lubricating oil flow path formed on the motor housing 2*c* or the housing of the gear casing 3. The internal piping 9 is a flow path through which lubricating oil is fed from the cooling jacket 2*j* to the bearings 1*b* installed between the compressor body 1 and the electric motor 2. An opening of the internal piping 9 on the side of the cooling jacket 2*j* is located in a position lower than the oil level. Accordingly, when the oil level is located above the opening, lubricating oil is fed to the bearings 1*b* by free fall.

Furthermore, the pipings 35*c* and 35*d* which are lubricating oil paths to the bearings 1*b* and the timing gears 5*a* and 5*b* installed on the ejection side of the compressor body 1, the piping 35*e* which is a lubricating oil path to the bearing 2*b* installed on the side of the opposite-output-shaft end of the electric motor 2, and the piping 35*a* which is the upstream of these pipings are installed at positions lower than the level of lubricating oil in the cooling jacket 2*j* (on the side of the side surface of the compressor 104) (in FIG. 4(*a*), each piping indicated by a dashed line shows that the piping is located in a "lower position."). An installation relationship of these pipings 35*a*, 35*c*, 35*d*, and 35*e*, etc. is specifically described with FIG. 4(*b*).

FIG. 4(*b*) schematically shows an external elevation of the compressor 104 when viewed from the compressor body 1 in a direction of the rotation axis. As shown in FIG. 4(*b*), the piping 35*a* is provided with an opening at the level that is on the outer circumference of the motor housing 2*c* lower than the position of the oil level of lubricating oil (a dot-and-dash line) and is around the position in a horizontal direction corresponding to the shaft center of the rotor shaft 31 or the like. Likewise, the pipings 35*c* and 35*d*, etc. are provided with an opening in the same level range. Dotted lines connecting the pipings 35*c* and 35*d*, etc. indicate a relation of connection between the pipings. Incidentally, the piping 35*e* (not shown) is also provided with an opening in the same level range.

As the opening positions of the pipings are lower than that of the oil level in the cooling jacket 2*j*, circulation of lubricating oil by gravity fall can be expected. Furthermore, as the opening positions of the pipings 35*c*, 35*d*, and 35*e* are near the shaft center in the horizontal direction, it is possible to expect to certainly feed lubricating oil to the timing gears 5*a* and 5*b* and the ejection-side bearings 1*b* installed on the outer circumference of the rotor shaft 31, etc. and the bearing 2*b* of the opposite-output-shaft end. Incidentally, it can be said that the opening positions are preferably slightly above an extension of the shaft center in the horizontal direction.

As described above, according to Embodiment 4, it enables certain feeding of lubricating oil by gravity fall, and expands the flexibility in the piping configuration of lubricating oil.

Furthermore, by adjusting especially the level of the opening position of the piping 35*a*, it is possible to limit the amount of lubricating oil fed when the oil pump is at a stop.

Moreover, gravity fall is used in feeding of lubricating oil to the gears, etc.; thus, it can be said that the oil pump 6 only has to feed the predetermined amount of lubricating oil to the cooling jacket 2*j*. Therefore, there is no need to actively generate feeding pressure to the pipings, which makes it possible to achieve the reduction in energy and the miniaturization of the pump.

Incidentally, the atmosphere communicating part 8 can be obviously set as a lubricating oil replenishing port.

Embodiment 5

Embodiment 5 is described. One of the characteristics of an oilless screw compressor in Embodiment 5 (hereinafter, referred to as "compressor 105") is that the internal space of the cooling jacket 2*j* of the electric motor 2 is divided into two upper and lower parts, and the oil pump 6 is driven with driving force of the electric motor 2 that is a drive source of the compressor body 1.

Figure 5A:
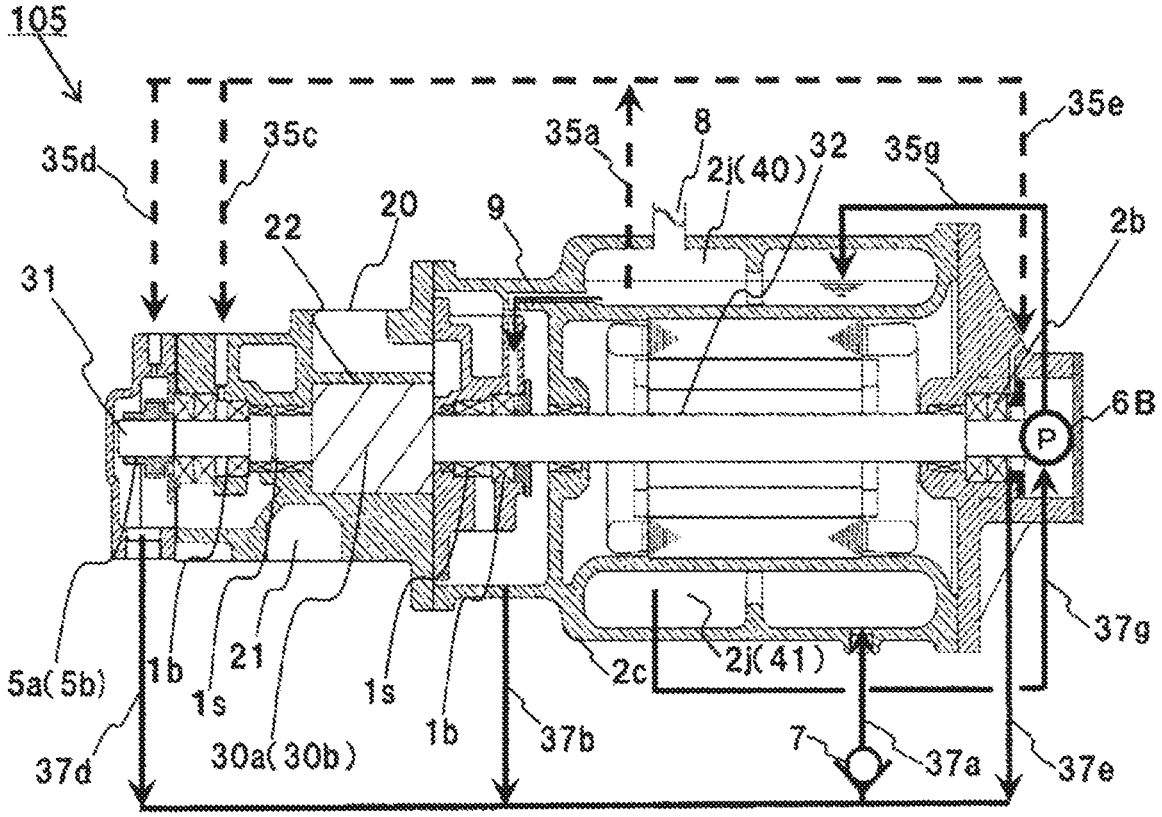
FIGS. 5A and 5B are schematic diagrams showing a longitudinal cross-sectional side view of an oilless screw compressor according to Embodiment 5 and a schematic diagram showing a cross-section of an electric motor.
Figure 5B:
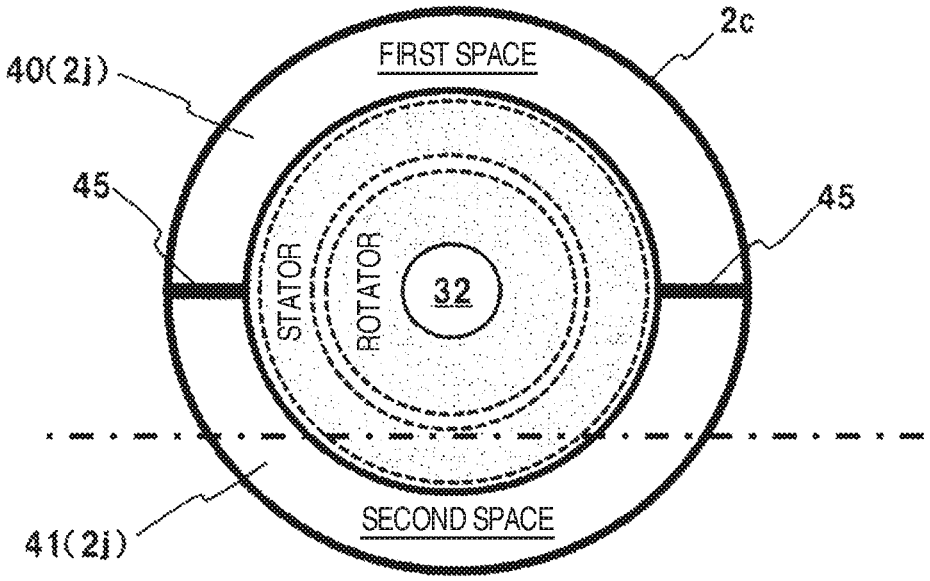

FIG. 5(*a*) shows a longitudinal cross-sectional side view of the compressor 105. Incidentally, the compressor 105 is based on the configuration of the compressor 104 in Embodiment 4; the same member is assigned the same reference numeral, and detailed description of the member is omitted.

The compressor 105 includes an oil pump 6B at an opposite-output-shaft end of the motor shaft 32; the oil pump 6B obtains a force for feeding lubricating oil by corotation. Furthermore, the internal space of the cooling jacket 2*j* is configured to be divided into an upper first space 40 and a lower second space 41.

FIG. 5(*b*) schematically shows a cross-section of the electric motor 2 viewed from the axial direction. The cooling jacket 2*j* is provided with partitions 45 on either side of the inside of the cooling jacket 2*j* along an extending direction of the shaft 32 in accordance with a horizontal line passing through the shaft center of the motor shaft 32, thereby forming the first space 40 on the upper side and the second space 41 on the lower side.

Incidentally, in the present embodiment, the internal space of the cooling jacket 2*j* is configured to be divided into two equal upper and lower parts: the first and second spaces by a horizontal line passing through the shaft center of the motor shaft 32; however, the division position can be configured to shift downward. That is, as will be described later, lubricating oil after having been used to lubricate the gears, etc. is circulated back to the second space 41 by gravity; however, the amount of lubricating oil discharged from the compressor body 1 and the gear casing 3 may sometimes be less than the capacity of the second space 41. In this case, the oil level in the second space 41 is substantially lower than the shaft center, an area where lubricating oil is not circulated around is generated on the upper side of the second space, and there may exist a part not suited for cooling of the electric motor 2. Accordingly, to secure the capacity appropriate for the amount of lubricating oil discharged from the compressor body 1, etc., the division position of the cooling jacket 2*j* can be set in a lower position (for example, such as indicated by a dot-and-dash line in FIG. 5(*b*)).

To return to FIG. 5(*a*), lubricating oil fed from the first space 40 to the gears and the bearings through pipings such as the piping 35*a* is eventually circulated back to the second space 41 through pipings such as the piping 37*a*. The oil pump 6B is installed in the middle of pipings 37*g* and 35*g* that connect the second space 41 and the first space 40, and is configured to feed lubricating oil of the second space 41 to the first space 40.

Furthermore, pipings such as the piping 35*a* through which lubricating oil is fed to the gears and the bearings are configured to use gravity fall of lubricating oil as with Embodiment 4. Moreover, the second space 41 is located in a position lower than the timing gears 5*a* and 5*b* and the bearings 1*b* and 2*b*, and also the openings of pipings such as the piping 37*c* through which the lubricating oil is discharged are located in a position higher than the second space 41. Therefore, the discharged lubricating oil is spontaneously circulated back to the second space 41 located in the lower position by gravity.

In this way, according to Embodiment 5, in addition to liquid cooling of the electric motor 2, by forming the second space 41 in which the oil level is lower than the gears and bearings to be lubricated, the natural backward flow of lubricating oil can be achieved on a discharge path of the lubricating oil after lubrication as well and the simplified configuration can be achieved.

Furthermore, by appropriately adjusting the vertical installation positions of the partitions 45, it is possible to prevent an area partially not filled with lubricating oil from being generated in the second space 41 of the cooling jacket 2*j*, and is possible to ensure cooling of the electric motor 2.

Moreover, the oil pump 6 is modified into the self-excited oil pump 6B and is configured to be integral with the opposite-output-side bracket of the motor housing 2*c*, thereby it is possible to achieve the miniaturization/compactification of the configuration of the entire compressor 105, and is possible to reduce energy for lubrication of machine elements and cooling of the electric motor 2.

Embodiment 6

Embodiment 6 is described. Embodiment 6 is an example where Embodiments 1 to 5 are configured as a compressor component 50.

Figure 6:
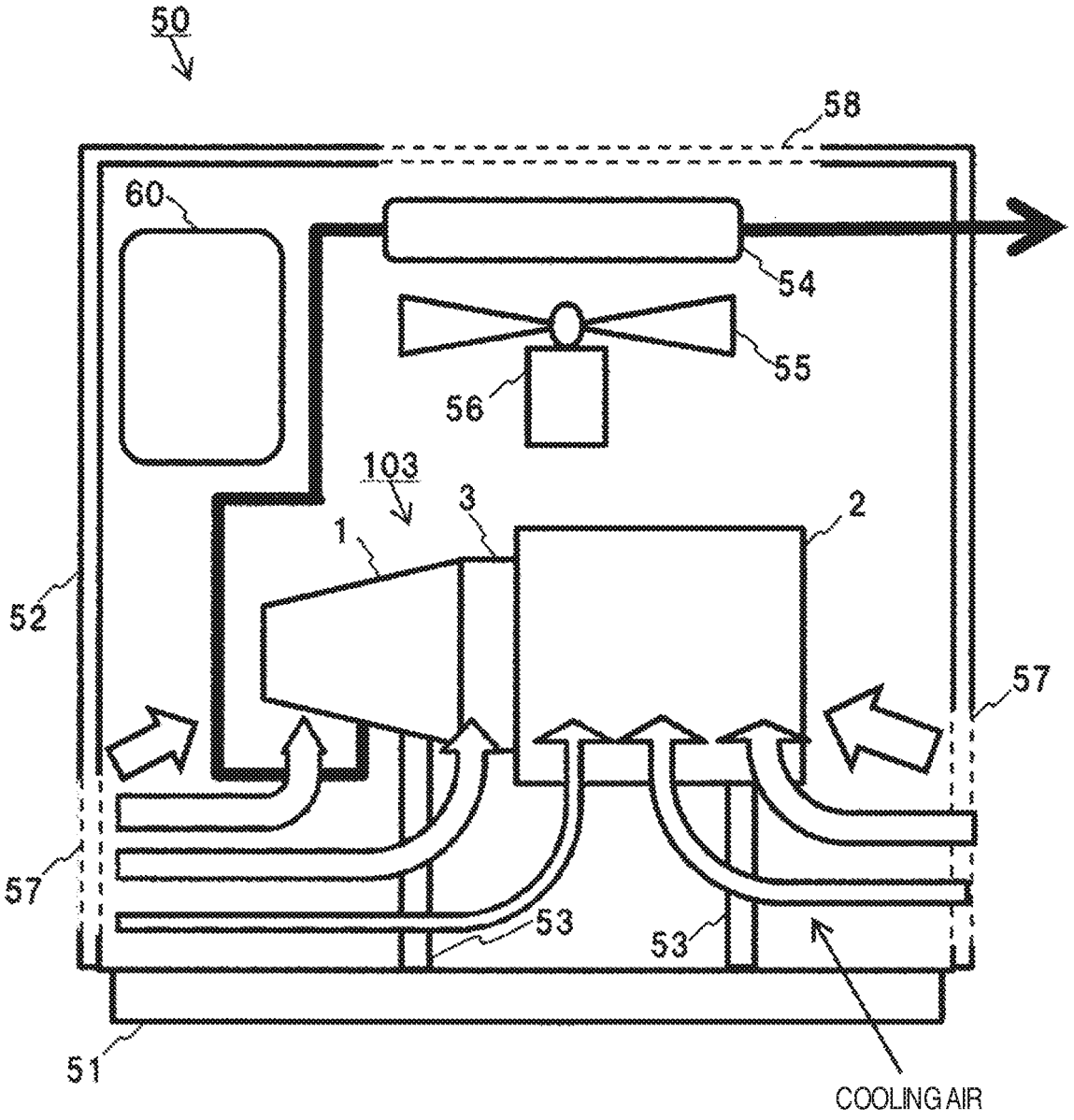
FIG. 6 is a schematic diagram showing a schematic configuration of an oilless screw compressor component according to Embodiment 2.

FIG. 6 schematically shows a configuration of the compressor component. Incidentally, for convenience of description, the compressor 103 in Embodiment 3 is taken as an example.

The compressor component 50 includes a base 51, a package panel 52 composed of a combination of multiple metallic plates, a leg part 53 for installing the compressor 103 on the base 51, an air cooler 54, a fan 55, a fan motor 56, a control device 60, etc. The compressor 103 is fixed to the base 51, and the leg part 53 extending in a vertical direction is connected and fixed to part of the housing of the compressor body 1, the motor housing 2*c*, or the like through vibration-proof material or the like composed of an elastic body such as rubber, and is horizontally installed (transversely placed) with the direction of the rotation axis as a horizontal direction.

The package panel 52 is provided with an air inlet 57 from which outside air is introduced into the component on the lower side thereof, and is provided with a scavenging port 58 from which air is scavenged to the outside is provided on the top panel thereof. The air cooler 54 cools ejected air with high pressure increased by compression down to a desired temperature. The air cooler 54 is installed between the scavenging port 58 and the compressor 103. Furthermore, the fan 55 and the fan motor 56 that generate the flow of air from the air inlet 57 to the scavenging port 58 are installed between the air cooler 54 and the compressor 101. Ejected air resulted from heat exchange with cooling air of the fan 55 is then supplied to the user side by the air cooler 54.

The compressor 103 (the same is true on the compressors 101, 102, 104, and 105) is configured to feed lubricating oil on the upper side of the cooling jacket 2*j* to the side of the compressor body 1 and the gear casing 3 and collect the lubricating oil after lubrication on the lower side of the cooling jacket 2*j*. This configuration is suited to cool lubricating oil in the cooling jacket 2*j* in the compressor component 50.

Specifically, lubricating oil after lubrication of the gears, etc. absorbs heat of each part; therefore, lubricating oil collected on the lower side of the cooling jacket 2*j* tends to have a higher temperature than that on the upper side. When the compressor 101 is transversely placed, cooling air flowing upward from the bottom in the component from the air inlet 57 toward the scavenging port 58 is directly and much hit by the lower side of the motor housing 2*c*. That is, the upstream side of the cooling air directly hits the lower side of the electric motor 2.

Accordingly, it is possible to achieve an effect of being able to achieve an effect of facilitating cooling of lubricating oil on the lower side of the relatively-high-temperature cooling jacket 2*j*.

The embodiments of the present invention are described above; however, the present invention is not limited to the above-described configurations, and various configurations can be applied without departing from the scope of the invention, and the configuration of one embodiment can also be applied to that of another embodiment.

For example, the cooling jacket 1*j* for cooling the compressor body 1 in Embodiment 2 can be applied to the other embodiments. Furthermore, the level of the pipings 35*a*, 35*c*, 35*d*, and 35*e* in Embodiments 4 and 5 can be applied to Embodiments 1 to 3.

Moreover, as feeding paths of lubricating oil, the pipings 35*a* to 35*f* and 37*a* to 37*e* are provided outside the compressor; however, some or all of these can be formed, by a three-dimensional shaping machine or the like, as a flow path communicated with the inside such as the compressor body 1, the gear casing 3, and the motor housing 2*c*.

REFERENCE SIGNS LIST

1 Compressor body
1*b* Bearing
1*j* Cooling jacket
1*s* Shaft seal
2 Electric motor
2*b* Bearing
2*c* Motor housing
2*j* Cooling jacket
2*s* Shaft seal
3 Gear casing
4*a* Drive gear
4*b* Driven gear
5*a*, 5*b* Timing gear
6 Oil pump
7 Check valve
8 Atmosphere communicating part
9 Internal piping
10 Lubricating oil feed piping
11 Oil cooler
12 Temperature control valve
20 Air inlet
21 Outlet
22 Compression operation chamber
30*a* Male rotor
30*b* Female rotor
31 Rotor shaft
32 Motor shaft
35*a*, 35*b*, 35*c*, 35*d*, 35*e*, 35*f*, 35*g* Piping
37*a*, 37*b*, 37*c*, 37*d*, 37*e*, 37*g* Piping
39 Oil inlet
49 Outlet
50 Compressor component
51 Base
52 Package panel
53 Leg part
54 Air cooler
55 Fan
56 Fan motor
57 Air inlet
58 Scavenging port
101, 102, 103, 104, 105 Oilless screw compressor

The invention claimed is:

1. An oilless compressor comprising:

a compressor body having a rotor for compressing air, a rotor shaft for supporting the rotor and a bearing for rotatably supporting the rotor shaft;

an electric motor that generates driving force for driving the compressor body;

a lubricating oil piping that feeds lubricating oil to the bearing; and an oil pump that pumps the lubricating oil, wherein the electric motor includes a cooling jacket for circulating the lubricating oil into an internal flow path via the lubricating oil piping, thereby cooling an armature of the electric motor, the compressor body includes a compressor-body cooling jacket having a flow path through which the lubricating oil is circulated into the internal flow path, thereby cooling the compressor body, and the lubricating oil is circulated into the lubricating oil piping after having been circulated from the cooling jacket into the compressor-body cooling jacket.

2. The oilless compressor according to claim 1, wherein the electric motor includes the cooling jacket in an outer circumferential direction of the armature of the electric motor, and the compressor body includes the compressor-body cooling jacket in an outer circumferential direction of the rotor.

3. The oilless compressor according to claim 1, wherein the cooling jacket is divided into a pair of upper and lower parts, the upper cooling jacket having a lubricating oil outlet on an upper side of the upper cooling jacket, the lower cooling jacket having a lubricating oil return port on a lower side of the lower cooling jacket, and the lubricating oil piping includes a piping through which lubricating oil of the lower cooling jacket is circulated back to the upper cooling jacket.

4. The oilless compressor according to claim 1, wherein the oil pump is installed at an opposite-output-shaft-side end of a rotation shaft of the electric motor, and is driven by rotary drive of the electric motor.

5. The oilless compressor according to claim 1, wherein an oil cooler for cooling lubricating oil with air or water is installed on the lubricating oil piping.

6. The oilless compressor according to claim 5, wherein the lubricating oil piping includes:

a bypass piping connecting a piping on an upstream of an inlet of the oil cooler to a piping on a downstream of an outlet of the oil cooler; and a changeover valve that changes a flow path of the lubricating oil to the bypass piping or the oil cooler.

7. The oilless compressor according to claim 1, wherein a rotation shaft of the electric motor and an axial direction of the rotor shaft are parallel to each other and same in horizontal position.

8. The oilless compressor according to claim 1, wherein a rotation shaft of the electric motor and the rotor shaft are configured to be integral with each other.

9. The oilless compressor according to claim 1, further comprising:

at least one gear that transmits the driving force to the rotor shaft, wherein the lubricating oil piping feeds the lubricating oil to at least either the bearing or the at least one gear.

10. An oilless compressor comprising:

a compressor body having a rotor for compressing air, a rotor shaft for supporting the rotor and a bearing for rotatably supporting the rotor shaft;

an electric motor that generates driving force for driving the compressor body;

at least one gear that transmits the driving force to the rotor shaft;

a lubricating oil piping that feeds lubricating oil to at least either the bearing or the at least one gear; and an oil pump that pumps the lubricating oil, wherein the electric motor includes a cooling jacket in an outer circumferential direction of an armature of the electric motor, the cooling jacket circulating the lubricating oil into an internal flow path, thereby cooling the armature, and the electric motor circulates the lubricating oil into the cooling jacket and the lubricating oil piping, the cooling jacket has a lubricating oil outlet on an upper side and a lubricating oil return port on a lower side of the cooling jacket.

11. The oilless compressor according to claim 10, wherein a level of at least either the bearing or the gear is lower than a position of an oil level of lubricating oil in the cooling jacket.

12. The oilless compressor according to claim 10, wherein of the lubricating oil piping, a lubricating oil piping through which lubricating oil is fed from the cooling jacket to at least either the bearing or the gear is installed on an upper side of the oilless compressor, thereby feeding the lubricating oil from above the bearing and the gear.

13. The oilless compressor according to claim 10, wherein of the lubricating oil piping, a lubricating oil piping through which lubricating oil is fed from the cooling jacket to at least either the bearing or the gear feeds the lubricating oil from above a level of a radial center of the bearing or the gear.

14. An oilless compressor comprising:

a compressor body having a rotor for compressing air, a rotor shaft for supporting the rotor and a bearing for rotatably supporting the rotor shaft;

an electric motor that generates driving force for driving the compressor body;

at least one gear that transmits the driving force to the rotor shaft;

a lubricating oil piping that feeds lubricating oil to at least either the bearing or the at least one gear; and an oil pump that pumps the lubricating oil, wherein the electric motor includes a cooling jacket in an outer circumferential direction of an armature of the electric motor, the cooling jacket circulating the lubricating oil into an internal flow path, thereby cooling the armature, the electric motor circulates the lubricating oil into the cooling jacket and the lubricating oil piping, and the oilless compressor further comprises an atmosphere communicating part communicated with outside air on an upper side of the cooling jacket.

* * * * *